United States Patent [19]

Daugherty

[11] 4,446,178

[45] May 1, 1984

[54] DECORATIVE BAR SOAP HOLDER

[76] Inventor: Yvonne B. Daugherty, 567 Sea Pine La., Deer Creek, Deerfield Beach, Fla. 33441

[21] Appl. No.: 421,584

[22] Filed: Sep. 22, 1982

[51] Int. Cl.[3] ..... A41G 1/00

[52] U.S. Cl. ..... 428/26; D6/89; D7/5; 15/104.92; 15/105; 15/176; 132/81; 132/85; 206/77.1; 248/309 R; 248/316 R; 401/18; 401/88; 401/52; 401/195; 401/268

[58] Field of Search ..... 428/24, 25, 26; D6/89; D7/5; 401/19, 81, 18, 88, 52, 195, 268; 206/77.1; 15/105, 176, 104.92; 248/309 R; 132/81, 85

[56] References Cited

U.S. PATENT DOCUMENTS

| | | | |
|---|---|---|---|
| D. 107,889 | 1/1938 | Welles | D7/5 |
| D. 211,887 | 8/1968 | Dearling | D6/89 |
| 2,583,207 | 7/1948 | Buck | D6/89 |
| 3,008,165 | 11/1961 | Scholl | 15/176 |
| 3,281,881 | 11/1966 | Yetter | 15/167 |

*Primary Examiner*—George F. Lesmes
*Assistant Examiner*—P. R. Schwartz
*Attorney, Agent, or Firm*—Harvey B. Jacobson; Harvey B. O'Brien

[57] ABSTRACT

A base assembly is provided for support from a suitable support surface and the base assembly includes a raised central portion spaced inwardly of the outer peripheral portions of the base assembly and provided with horizontally spaced apart tufts of upstanding bristles supported therefrom. The upper ends of the tufts may be used to support a bar of soap therefrom and the base assembly includes three superposed panel members each including peripherally spaced petal defining marginal portions. The lower panel member of the base assembly includes a plurality of the upstanding locking lugs as well as a plurality of upstanding locator pins supported therefrom. The panel members disposed above the lower panel member each include upstanding locator pin receiving openings and locking lug receiving openings form therein upwardly through which the locator pins and the locking lugs are received. The locking lugs project slightly above the uppermost locking lug receiving openings and include downwardly facing laterally projecting abutment surfaces snap engageable over portions of the upper panel member disposed about the locking lug receiving openings therein and the upper ends of the locator pins project above the upper ends of the locator pin openings in the upper panel member and are upwardly telescoped into downwardly opening cavities or recesses formed in the aforementioned raised central portion, the latter being upwardly removeable from the upper panel member and the upper ends of the locator pins.

6 Claims, 7 Drawing Figures

DECORATIVE BAR SOAP HOLDER

BACKGROUND OF THE INVENTION

Various forms of soap dishes and holders heretofore have been provided, but most previous dishes and holders are not operable to perform a dual function. In addition, many previously known soap dishes and holders do not include a pleasing and decorative appearance and tend to collect dried soap on the portions thereof which are used to support a bar of soap.

Accordingly, a need exists for a bar soap holder which may perform not only the function of holding a bar of soap, but may also comprise a washing accessory and be constructed in an aesthetically pleasing manner and further in a manner whereby the portion of the holder to support a bar of soap will be less likely to accumulate dried soap thereon.

Examples of previously known soap holders as well as other devices including some of the general structural operational features of the incident invention are disclosed in U.S. Pat. Des. Nos. 184,219, 212,335, U.S. Pat. Nos. 846,936, 1,966,247, 2,475,500, 2,504,536, 2,583,207, 2,973,601 and 4,203,568.

BRIEF DESCRIPTION OF THE INVENTION

The soap dish and holder of the incident invention includes three vertically superposed horizontal panels with the lower panel including upstanding locator pins and locking lugs. The panels disposed above the lower panels include openings formed therethrough upwardly through which the locator pins and the locking lugs are received and the locking lugs include laterally directed upper end heads which are snap engageable over upwardly facing surface portions of the upper panel disposed about the locking lug receiving openings formed therein. In this manner, the panels are secured together against accidental separation and the locator pins project above the upper panel to an extent wherein the upper ends of the locator pins are upwardly telescoped into downwardly receiving sockets carried by a raised bar soap supporting member disposed over the upper panel, the locator pins serving as to prevent lateral displacement of the bar soap supporting member relative to the panels. However, the bar soap supporting member is upwardly displaceable from engagement with the locator pins and includes upwardly projecting tufts of bristles on its upper surface for supporting a bar of soap from the bar soap supporting member, the latter being usable as a scrubbing brush when removed from the locator pins. The outer peripheral portions of the three panels define peripherally spaced petal simulating projections and the petal simulating projections of the lower panel are generally horizontal, the projections of the intermediate panel are slightly upwardly and outwardly inclined and the petal projections of the upper panel are more greatly upwardly and outwardly inclined. In other words, the decorative bar soap holder includes a soap bar support body overlying said upper panel member and stationarily supported relative thereto, said support body including upwardly projecting soap bar support members for supporting a soap bar therefrom in elevated position relative to said support body, said lower, second, and upper panel members including peripherally spaced decorative portions spaced thereabout.

The main object of this invention is to provide a decorative bar soap holder having a pleasing appearance.

Another object of this invention is to provide a bar soap holder including a bar soap support which will tend not to have dried soap accumulate thereon.

Another important object is to provide a bar soap holder including a soap bar support including upwardly projecting tufts of bristles and which may be removed from the remainder of the holder and utilized as a scrubbing brush.

A final object of this invention to be specifically innumerated herein is to provide a bar soap holder in accordance with the preceeding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
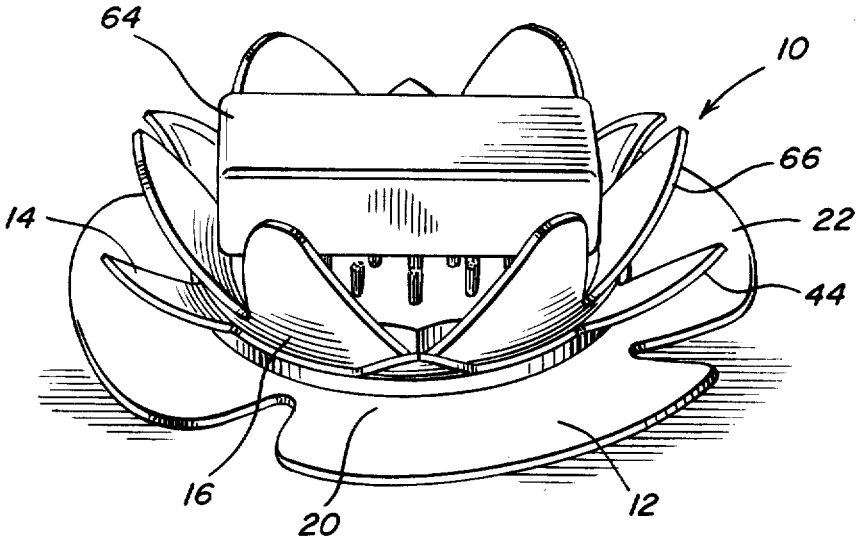
FIG. 1 is a prospective view of the complete bar soap holder and with a bar of soap supported therefrom.
Figure 2:
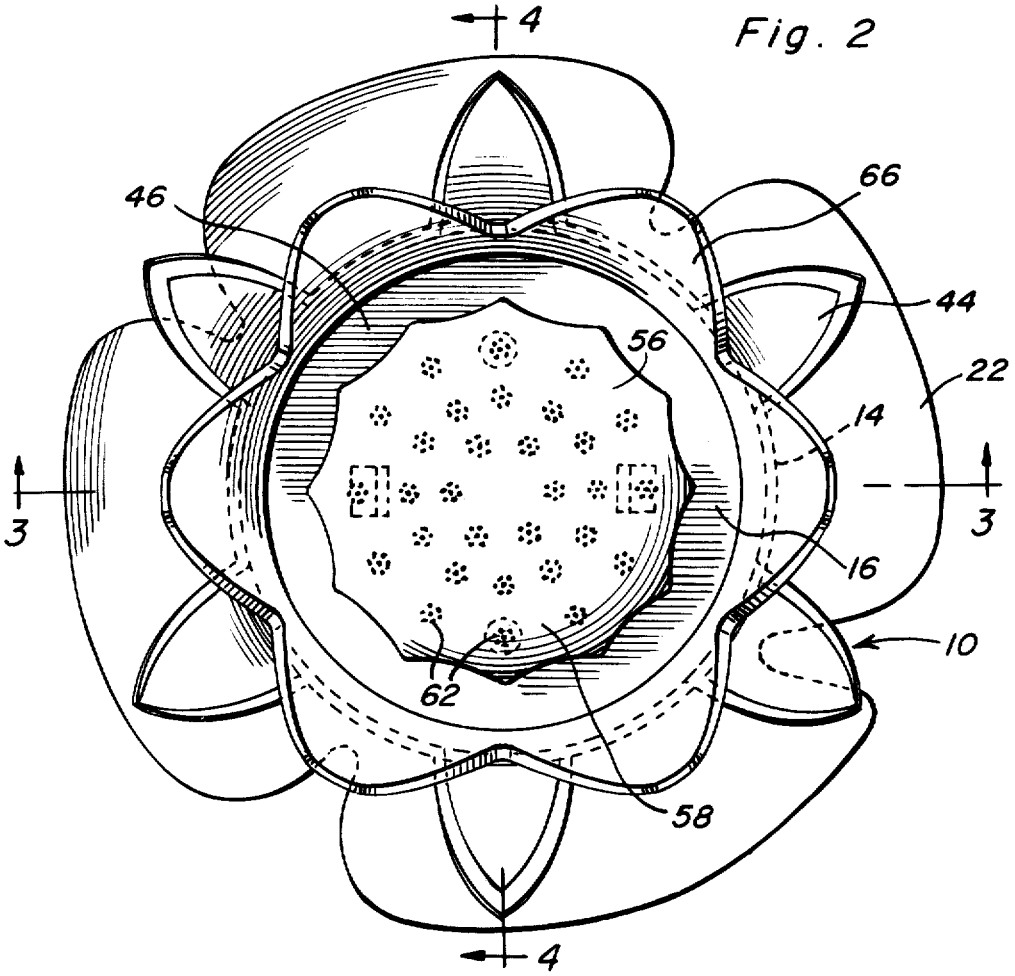
FIG. 2 is an enlarged top plan view of the holder independent of the bar of soap.
Figure 3:
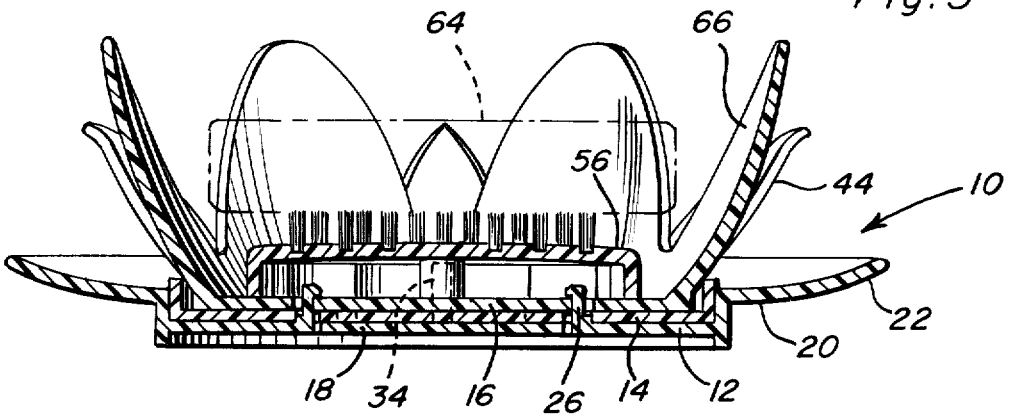
FIG. 3 is a vertical sectional view taken substantially upon the plane indicated by the section line 3—3 of FIG. 2.
Figure 4:
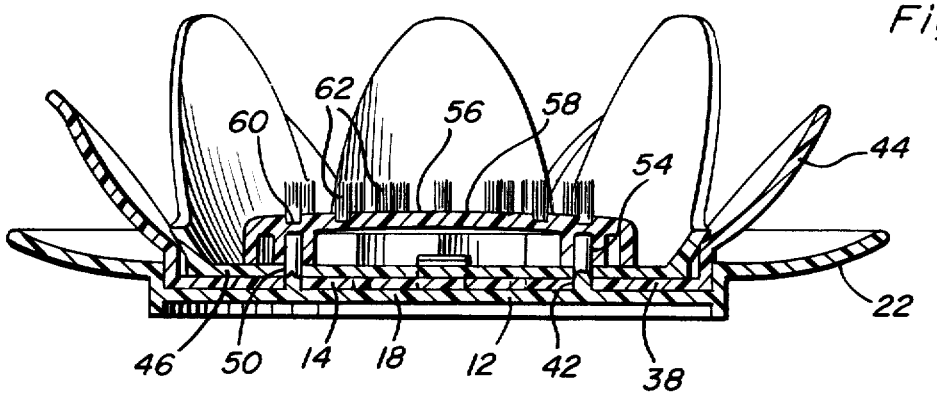
FIG. 4 is a vertical sectional view taken substantially upon the place indicated by the section line 4—4 of FIG. 2.
Figure 5:
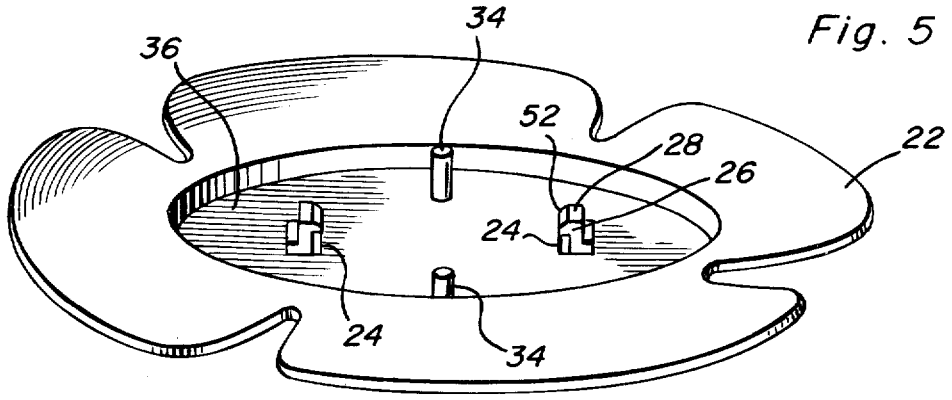
FIG. 5 is a prospective view of the lower panel of the holder.
Figure 6:
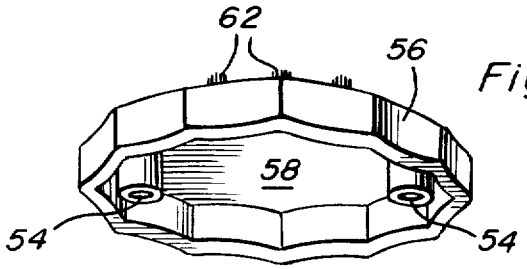
FIG. 6 is an underside prospective view of the bar soap supporting member of the holder.
Figure 7:
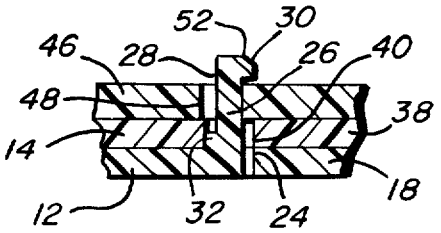
FIG. 7 is an enlarged fragmentary vertical sectional view illustrating the manner in which the locking lugs carried by the lower panel may be utilized to secure the three panels against accidental separation relative to each other.

Referring now more specifically to the drawings the numeral 10 generally designates the bar soap holder of the incident invention. The holder 10 includes three superposed lower, intermediate and upper panels 12, 14 and 16. The panel 12 includes a depressed central portion 18 and a raised outer peripheral portion 20 including peripherally spaced slightly upwardly and outwardly inclined petal simulating projections 22. In addition, the central portion 18 includes a pair of diametrically opposite openings 24 formed therein and a pair of upstanding locking lugs 26 disposed immediately radially inwardly of the openings 24 and including enlarged upper end heads 28 defining laterally outwardly projecting and downwardly facing abutment surfaces 30. In addition, locking lugs 26 include slightly laterally enlarged lower end portions 32. Also, the central portion 18 includes a pair of upstanding locator pins 34 disposed on a diameter of the circular center portion 18 normal to the diameter of the center portion 18 upon which the locking lugs at 26 are disposed.

The depressed central portion 18 defines a shallow upwardly opening recess 36 in which a central portion 38 of the panel 14 is received and the center portion 38 additionally includes locking lug receiving openings 40 and locator pin receiving openings 42 formed therein. The locking lugs 26 are received upwardly through the openings 40 and the locator pins 34 are received upwardly through the openings 42 with the central portion 38 snugly received within recess 36. The panel 14 also includes peripherally spaced outer marginal projections 44 which simulate petals and are more sharply upwardly and outwardly inclined then the projections 22.

The panel 16 includes a central portion 46 having locking lug receiving openings 48 formed therein as well as locator pin receiving openings 50 formed therein upwardly through which the locking lugs 26 and locator pins respectively, are received. The heads 28 include cam surfaces 52 for engaging the outer marginal portions of the lower ends of the openings 48 in order to inwardly cam the upper ends of the locking lugs 26 upon downward displacement of the central portion 46 of the panel 16 toward surface-to-surface contacting relation with the upper surface of the central portion 38. Thus, the abutment surfaces 30 may be snapped engaged over the upper surfaces of the central portion 46 disposed immediately outwardly of the openings 48 in order to releaseably retain the panels 12, 14 and 16 in superposed relation. The locator pins 42 project considerably above the central portion 46 through the openings 42 and 50 and are upwardly telescoped into downwardly opening recesses 54 defined by a central bar soap supporting member 56 disposed over the central portion 46 of the panel 16. The bar soap supporting member 56 includes an upper wall 58 having horizontally spaced apart upwardly opening recesses 60 formed therein and the recesses 60 have tufts of bristles 62 anchored therein, the upper ends of the bristles supporting a bar 64 of soap therefrom. The panel 16 includes peripherally spaced marginal projections 66 which are sharply upwardly inclined and the projections 66 also simulate petals.

It will be noted that the bar soap support member 56 may be upwardly displaced from engagement with the locator pins 50 and used as a scrubbing brush. Each of the panels 12, 14 and 16 may be constructed of plastic, as may the bar soap support member 56. Further, the panel 12 may be green or other leaf or petal colors and the panels 14 and 16 may be of the same color different from the color of the panel 12, or each of the panels 14 and 16 may be of a color different from each other and the panel 12. Further, the color of the bar support member 56 may be the same as the panel 16 or different from the panel 16 and either or both of the panels 12 and 14. In addition, each of the panels 12, 14 and 16 as well as the bar soap support member 56 may be substantially opaque, although these components may also be transparent or translucent.

In operation, the bar 64 of soap, when wet, may be placed upon the tufts 62 of bristles for support therefrom and drainage of excess water from the bar 64. During the next usage of the bar 64 the bar support member 56 may be used as a scrub brush and any accumulation of dried soap thereon automatically will be washed therefrom.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A decorative bar soap holder including an upwardly opening base assembly in which a bar of soap may be placed intermediate periods of bar soap usage, said base assembly including a first lower panel member including a plurality of upstanding locator pins and a plurality of upwardly projecting latching tongues whose upper end portions may be laterally flexed and include upper end downwardly facing laterally extending abutment shoulder portions spaced below the upper terminal ends thereof, a second panel member overlies said first panel member and including first and second sets of openings formed therethrough upwardly through which said pins and tongues project, at least one additional panel member overlying said second panel member and having latching tongue and locator pin openings formed therethrough upwardly through which the upper ends of said tongues and pins project, said shoulder portions overlying upwardly facing surface portions of said upper panel member adjacent said latching tongue openings and thereby serving to latch said panel members together against separation, a soap bar support body overlying said upper panel member and stationarily supported relative thereto, said support body including upwardly projecting soap bar support members for supporting a soap bar therefrom in elevated position relative to said support body, said lower, second and upper panel members including peripherally spaced decorative portions spaced thereabout.

2. The soap holder of claim 1 wherein decorative portions comprise blossom petal simulating outer peripheral portions of space there about.

3. The soap holder of claim 2 wherein the blossom petals simulating outer peripheral portions of said lower, second and upper panel members are progressively upwardly and outwardly inclined.

4. The soap holder of claim 1 wherein the upper ends of said locator pins project above the upper ends of the locator pin openings formed in said upper panel member, said soap bar support body defining a plurality of downwardly opening recesses into which the upper ends of said pins are removeably telescoped, said soap bar support members including a plurality of horizontally spaced apart tufts of upstanding bristles upon whose upper ends a bar of soap may rest.

5. The soap holder of claim 4 wherein said body is disc shaped and may be removed from said base assembly and used as a hand or bath brush.

6. The soap holder of claim 1 wherein said first, second and upper panel members are constructed of plastic.

* * * * *